US006910749B2

(12) United States Patent
Mueller

(10) Patent No.: US 6,910,749 B2
(45) Date of Patent: Jun. 28, 2005

(54) DEVICE FOR OPENING AND CLOSING A MOVABLE PART OF A PIECE OF FURNITURE

(75) Inventor: Wolfgang Mueller, Lustenau (AT)

(73) Assignee: Grass GmbH, Voralberg (AT)

( * ) Notice: Subject to any disclaimer, the term of this patent is extended or adjusted under 35 U.S.C. 154(b) by 64 days.

(21) Appl. No.: 10/306,202

(22) Filed: Nov. 27, 2002

(65) Prior Publication Data

US 2003/0117048 A1 Jun. 26, 2003

(30) Foreign Application Priority Data

Nov. 27, 2001 (DE) ..... 101 57 754

(51) Int. Cl.[7] ..... A47B 88/00; E05C 19/00

(52) U.S. Cl. ..... 312/333; 312/334.3; 312/330.1; 292/304

(58) Field of Search ..... 312/333, 334.3, 312/330.1; 292/304, 341.17

(56) References Cited

U.S. PATENT DOCUMENTS

| | | | | | |
|---|---|---|---|---|---|
| 1,842,998 | A | * | 1/1932 | Rebischke et al. | 292/93 |
| 2,271,431 | A | * | 1/1942 | Hauser et al. | 312/333 |
| 2,343,977 | A | * | 3/1944 | Jones et al. | 292/5 |
| 2,455,182 | A | * | 11/1948 | La Vallee | 62/131 |
| 2,556,612 | A | * | 6/1951 | Buntin | 312/334.12 |
| 2,882,112 | A | * | 4/1959 | Jarvi | 312/221 |
| 2,885,251 | A | * | 5/1959 | Howard | 312/222 |
| 2,992,031 | A | * | 7/1961 | Krause et al. | 292/29 |
| 3,222,115 | A | * | 12/1965 | Urbank | 312/333 |
| 3,245,744 | A | * | 4/1966 | Olson | 312/333 |
| 3,854,785 | A | | 12/1974 | Manner et al. | |
| 4,056,699 | A | | 11/1977 | Jordan | |
| 4,123,631 | A | | 10/1978 | Lewis | |
| 4,159,153 | A | * | 6/1979 | Yoshikawa | 312/333 |
| 5,020,868 | A | * | 6/1991 | Brunnert | 312/319.1 |
| 5,158,347 | A | | 10/1992 | Warren et al. | |
| 5,170,108 | A | | 12/1992 | Peterson et al. | |
| 5,564,228 | A | | 10/1996 | Geringer et al. | |
| 6,378,916 | B1 | * | 4/2002 | Huang | 292/27 |

FOREIGN PATENT DOCUMENTS

| | | |
|---|---|---|
| DE | 29507917 | 9/1995 |
| DE | 19753319 | 7/1998 |
| DE | 19821014 | 11/1999 |
| DE | 10008350 | 9/2001 |

* cited by examiner

*Primary Examiner*—Peter M. Cuomo
*Assistant Examiner*—Sarah C. Burnham
(74) *Attorney, Agent, or Firm*—John M. Harrington; Kilpatrick Stockton LLP

(57) ABSTRACT

A device for opening and closing a movable furniture part, in particular a drawer, door or shutter includes two trigger and drive units which each have a trigger member controllable by the action of an external force and a drive member coupled to the trigger member for moving the furniture part and one or more locking members for locking the furniture part in the closed position and release of the furniture part as a function of the action of an external force on one or more trigger members. The two trigger and drive units are coupled to one another synchronously and substantially without play by a path- and force-transmitting means.

6 Claims, 14 Drawing Sheets

DEVICE FOR OPENING AND CLOSING A MOVABLE PART OF A PIECE OF FURNITURE

FIELD OF THE INVENTION

The invention relates to a device for opening and closing a movable part of a piece of furniture, in particular a drawer, a furniture door, a shutter or the like.

BACKGROUND OF THE INVENTION

Such devices serve the purpose of enabling the opening and closure of drawers, doors, shutters and any other movable parts of a piece of furniture which, by way of example, for aesthetic reasons have no handle. Opening and closing such movable parts of a piece of furniture, for example by lateral operation of the front panel or another accessible part, is impractical and does not allow reliable operation.

Fittings for opening drawers are known which are operated in that the drawer is pushed in by a predetermined length of travel and then moved out by a spring mechanism. This function is achieved in known manner through what are known as touch latch fittings.

Fittings based on the touch latch principle are disclosed, for example, in the specifications DE 100 08 350 A1, DE 198 21 014 A1 or DE 295 07 917 U1.

Similar closure mechanisms, as described, for example, in DE 197 53 319 A1, use a closure mechanism based on a curved or sliding guideway. These mechanisms are relatively costly to produce.

In the fittings known in the state of the art it is disadvantageous that to push in the drawer an increased resistance must be applied for tensioning the spring mechanism.

Furthermore, the devices need a relatively large trigger path and in particular cannot be triggered and locked from any desired pressure point on a drawer facing or a door, etc, with exactly the same short trigger paths and with the same forces.

The object of the present invention is to specify a device which allows the opening and closure of a movable part of a piece of furniture by manual actuation at any point of this part of a piece of furniture with low opening and closure pressure and a small trigger path.

SUMMARY OF THE INVENTION

This task is solved according to the invention by the characteristics specified in the independent Claim 1.

The device comprises according to the invention two trigger and drive units which each possess a trigger member controllable by external application of force and a drive member linked to the trigger member for moving the furniture part. There is at least one locking member for locking the furniture part in the closed position and releasing the furniture part as a function of the external application of force on at least one trigger member, wherein the two trigger/drive units are coupled to one another in synchronous manner substantially without play by path- and force-transmitting means.

Advantageous developments and refinements of the invention are specified in the subsidiary claims.

The two trigger and drive units are advantageously arranged at a distance from one another on opposite sides of the movable furniture part.

In a preferred development of the invention each trigger and drive unit comprises a disengaging lever mounted pivotably directly or indirectly on the movable furniture part and acted on by a spring which acting in conjunction with a limit stop arranged in fixed position on the carcass of the piece of furniture determines the closed and open position of the movable furniture part. In doing so in the closed state of the movable furniture part one end of the disengaging lever fits against the limit stop of the carcass of the piece of furniture.

To improve synchronous operation and the trigger and drive properties of the device it can be provided that the free end of the disengaging lever is of fork-like construction and acts in conjunction with a limit stop constructed in the form of a pin located in fixed position.

The force of the spring exerted on the disengaging lever, that is the initial tension in the spring, is preferably adjustable so that the desired travel of the drawer in opening can be determined as a function of the size of the drawer and the weight of the drawer.

The disengaging lever itself is preferably constructed as a guide bar having two legs whose first leg forms the trigger member and whose second leg is coupled via at least one path- and force-transmitting connecting member to the second leg of the respective other disengaging lever of the opposite trigger and drive member.

The locking member preferably comprises a spring-loaded latch temporarily actively connected to one of the two trigger/drive units which operates in the manner of a known touch latch locking mechanism. Two latches may also be provided which each act on one of the trigger and drive units.

In advantageous manner the trigger/drive unit and the locking member are arranged on a common assembly panel to be fastened to the movable furniture part which panel may be covered by a cover. The assembly panel and/or the cover is rigidly connected to the movable furniture part.

On the disengaging lever a setting device can be provided by means of which the position of the first leg can be altered relative to the position of the second leg. By this means fine adjustment of the limit stop position of the first leg of the disengaging lever relative to the limit stop on the carcass of the piece of furniture is possible.

In order to achieve a controlled and reproducible opening operation, means can be provided according to the invention for limiting the movement of the furniture part brought about by the drive member.

For the means for transmitting path and force between the disengaging levers of the two trigger and drive members mechanical, electromechanical, pneumatic or hydraulic means may be provided. For example, the mechanical connecting members can be constructed as rigid, inherently stiff members, as flexible members or as cable-like members depending on whether they must be put under load only by pulling or also by pushing.

The device according to the invention affords substantial advantages with respect to the devices known in the state of the art.

The movable furniture part opens and closes safely and reliably regardless of the point on the movable furniture part at which the opening and closing pressure is exerted.

The opening movement may be triggered at any point on the movable furniture part with an almost constant, very short trigger path. Jamming or one-sided opening or locking of the movable furniture part does not occur.

Furthermore, due to the device according to the invention the transfer of the momentum of the movable furniture part, ie the jolt when the mass of the furniture part encounters the carcass of the piece of furniture in the closing position, is absorbed without damage to the carcass of the piece of furniture, the movable furniture part or the mechanism. At the same time it is also prevented that the engagement between the latch and the disengaging lever is not inadvertently released due to the impact and the resultant change in direction of the movable furniture part (rebound).

Other advantages of the device are:

suitable for heavy drawers, especially suitable for very wide drawers, when drawers are not too wide only one touch latch locking and unlocking member is needed on one side, the front gap in drawers is adjustable by means of adjustable-length connecting members, absolutely synchronous triggering and locking, trigger forces selectable by means of different springs or adjustable elastic forces, emergency unlocking possible because the drawer can always be pulled out manually, retrofitting possible, few and easily manufactured parts which can be used on the left and the right and low overall height for fitting under the base of the top surface and between the drawers.

When used in drawers the best mode of operation of the device according to the invention is in association with what is known as a draw-in device which is present in almost all draw-out guides in modern drawers and is, accordingly, not described in more detail. The disengaging force of the disengaging lever is chosen to be greater than the draw-in force of the draw-in device.

Due to the force of the draw-in device the sensor ends of the disengaging levers when the touch latch is engaged are pulled against the limit stops on both sides of the carcass of the piece of furniture and by this means the drawer is held securely in the closed position.

A plurality of exemplified embodiments of the invention is described in more detail below with reference to the figures in the drawing. The exemplified embodiments provide further features, advantages and possible applications of the invention.

DETAILED DESCRIPTION

The embodiments described relate exclusively to a movable furniture part in the form of a drawer which is arranged to be pulled out in known manner in the carcass of a piece of furniture. The exemplified embodiments can, of course, be transferred in the same or modified form to other movable furniture parts such as by way of example furniture doors, shutters, etc.

Figure 1:
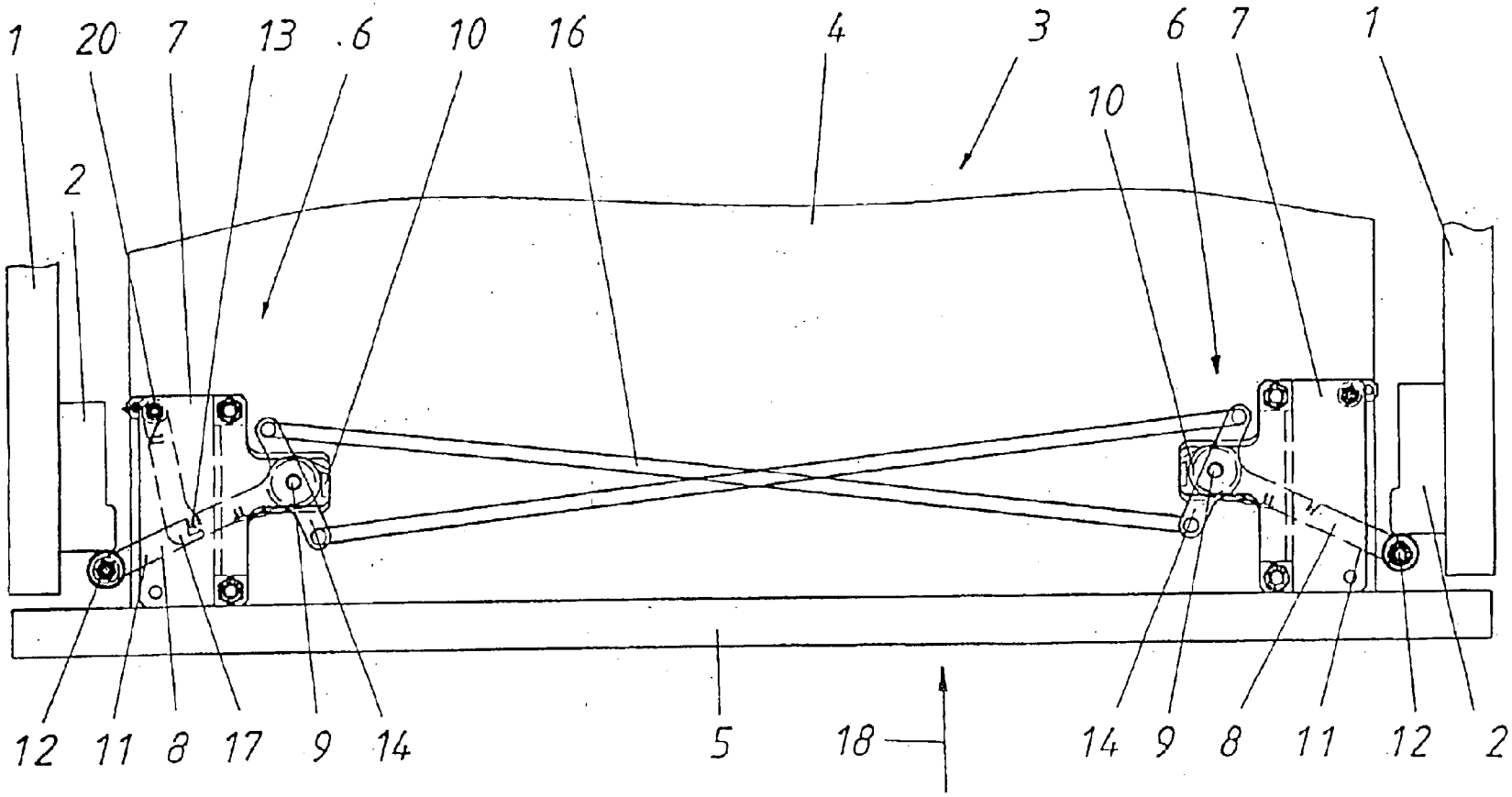
FIG. 1 a view from below of a drawer in the closed position fitted with a first embodiment of the device according to the invention.
Figure 2:
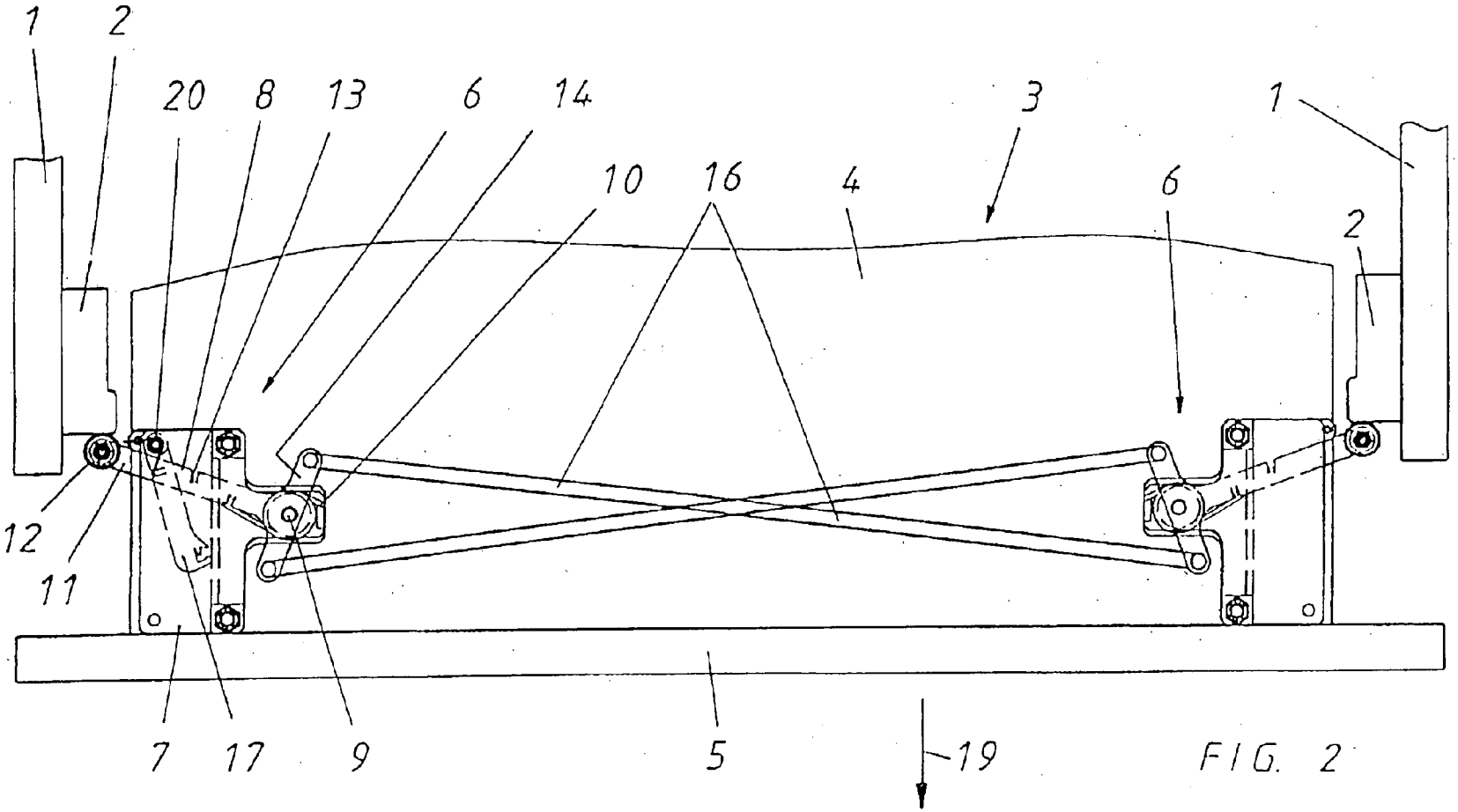
FIG. 2 the embodiment shown in FIG. 1 in the open position of the drawer by means of the device.

FIGS. 1 and 2 show a view from below of a drawer 3 which is held in known manner in a furniture carcass 1 by means of draw-out rails, for example. The bottom 4 and the front 5 of the drawer 3 are visible.

According to the invention trigger and drive members 6 are arranged on the side edges of the bottom 4 of the drawer close to the front 5 of the drawer. The trigger and drive members 6 comprise an assembly panel 7 on which an approximately T-shaped disengaging lever 8 is arranged pivotably in a pivot bearing 9. In the region of the pivot bearing 9 a torsion spring 10 is arranged which exerts an elastic force on the disengaging lever 8 so that its leg 11 forming a trigger member rests by its sensor roller 12 against a limit stop 2 of the furniture carcass 1. Furthermore, on the leg 11 a catch projection 13 is provided in which a spring-loaded, pivotable latch 17 engages which as a single member forms a known touch latch fitting and holds the disengaging lever 8 in a tensioned position. On the ends of the leg 14 of the disengaging lever 8 articulated connecting members are fitted. The connecting members 16 connect the leg 14 in each case to the leg 14 of the disengaging lever 8 of the other trigger and drive unit 6 opposite. This means that the two opposite disengaging levers 8 are connected to one another synchronously and without play so that the movement of one disengaging lever 8 is transmitted in the same way to the other disengaging lever 8.

Proceeding from the initial state shown in FIG. 1, if the drawer 3 is now pushed in slightly by hand in the direction of the arrow 18 the disengaging levers 8 are pivoted slightly since their sensor rollers 12 are resting against the limit stops 2 of the furniture carcass 1. As a result of the movement of the disengaging levers 8 the latch 17 is released from the catch projection 3 and sets the disengaging levers 8 free which due to the force of the spring 10 push away from the limit stop 2 of the furniture carcass 1 and due to the force of the spring the drawer 3 runs out to the end position of the disengaging levers in the direction of the arrow 19 as illustrated in FIG. 2. In this position the drawer is freely movable and can be fully opened by the user. It is important that the manual depression of the drawer for triggering the device can ensue at any point on the front panel since any movement of the drawer is transferred on account of the connecting members 16 in the same measure to both trigger and drive units 6 so that the latch 17 always responds reliably and releases or arrests the associated disengaging lever 8.

On closing the drawer the sensor rollers 12 of the disengaging levers 8 encounter the limit stops 2 on the furniture carcass 1. On further movement of the drawer the disengaging levers 8 are swivelled in and the spring 10 is put under tension. In the trigger position, that is in the position of being almost completely pushed in, the latch 17 captures one disengaging lever 8 and arrest it whereupon via the connecting members 6 the other disengaging lever 8 is arrested. In this position the drawer is preferably held closed by the known draw-in devices (not illustrated) in the draw-out guides.

Figure 3:
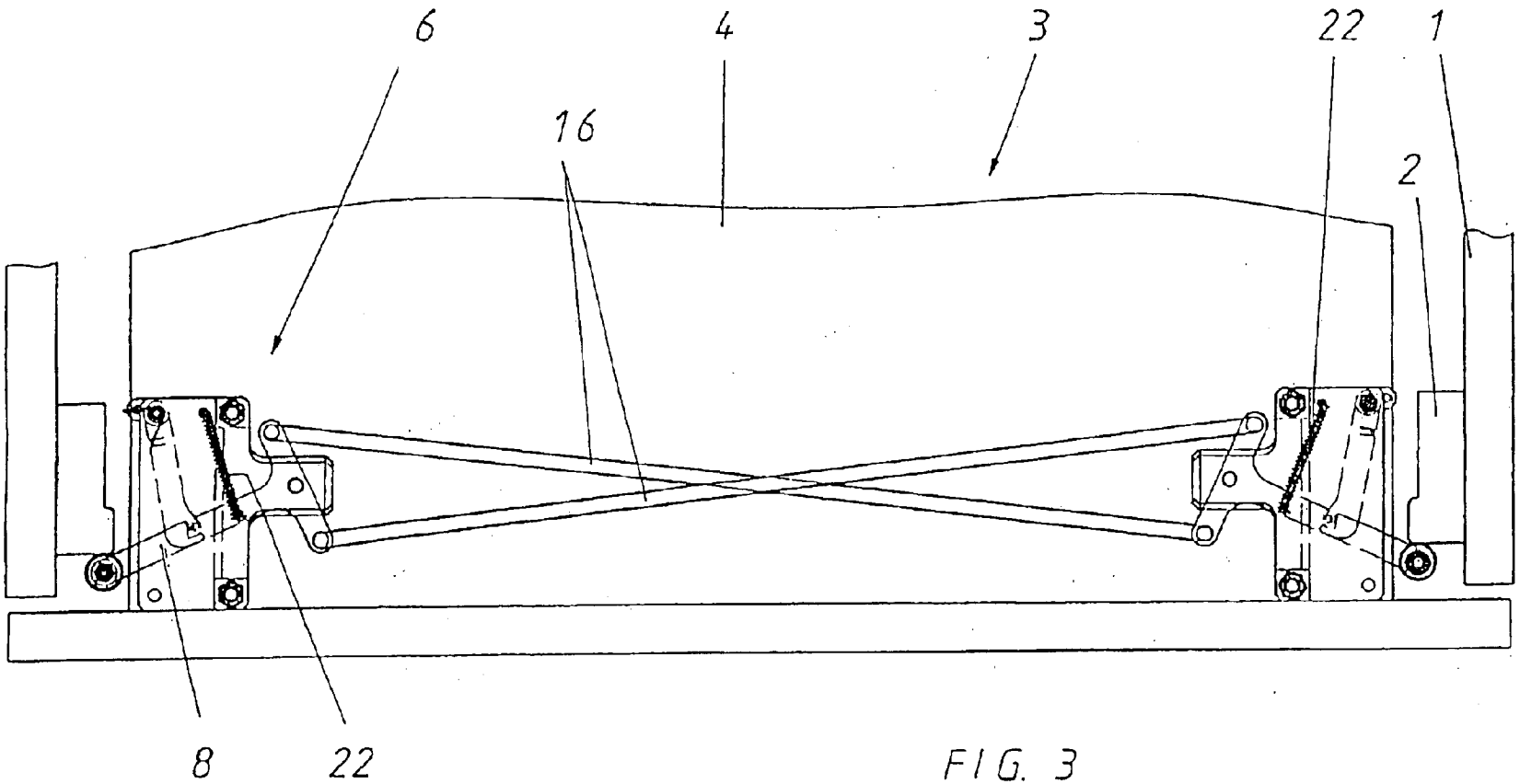
FIG. 3 a slightly modified embodiment with respect to FIGS. 1 and 2 with a tension spring as energy storage device.

FIG. 3 shows the embodiment of the device in FIGS. 1 and 2, wherein, however, the torsion spring 10 of the disengaging levers 8 is replaced by a tension spring 22 which fulfils the same function.

Figure 4:
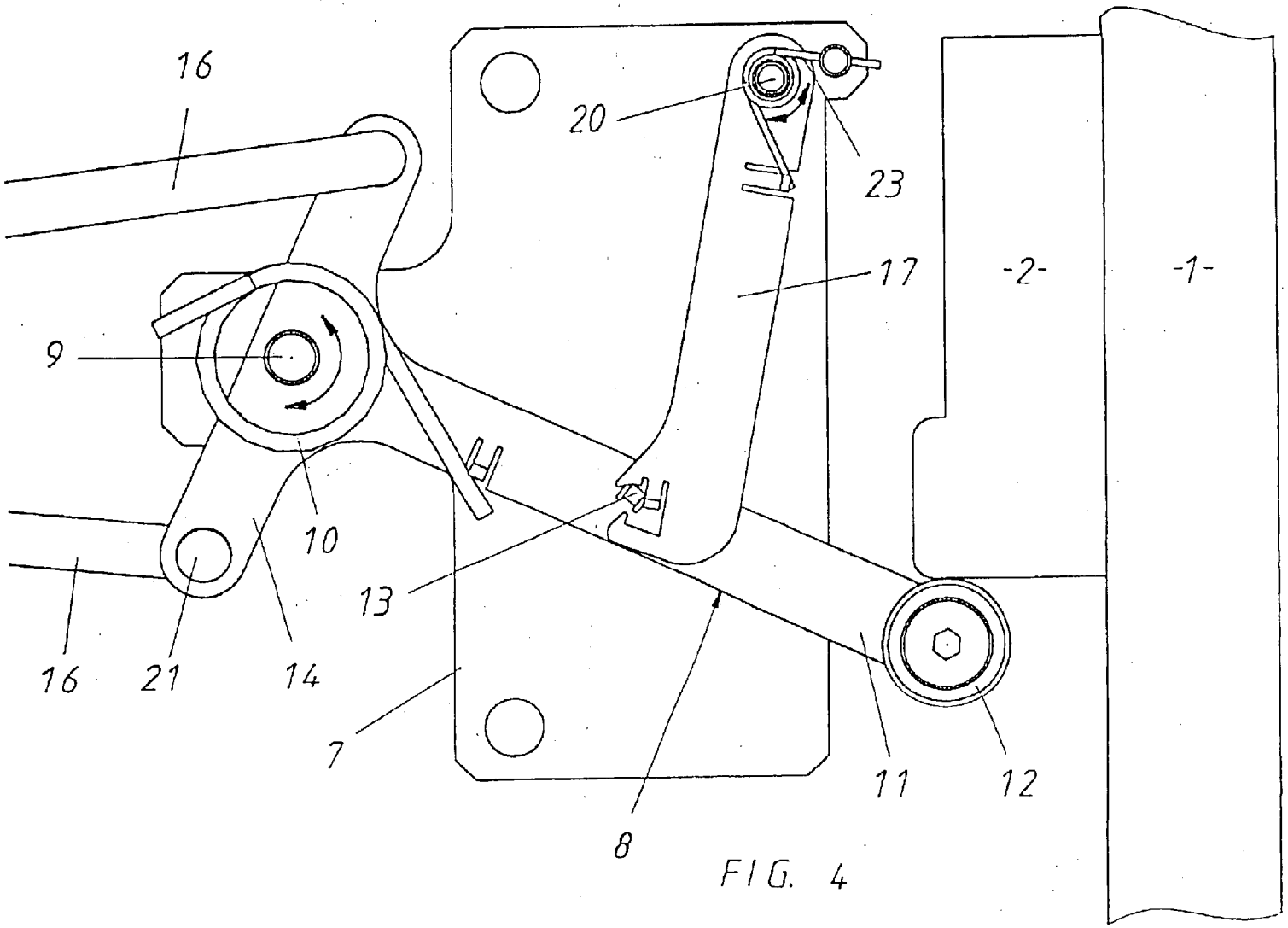
FIG. 4 an enlarged view of the device according to the invention shown in FIGS. 1 and 2.

FIG. 4 shows an enlarged view of a trigger and drive member 6 as shown in FIGS. 1 and 2. The assembly panel 7 may be seen on which the disengaging lever 8 is pivotably mounted in the pivot bearing 9 and is pretensioned by the torsion spring 10. The leg 11 of the disengaging lever is supported via the sensor roller 12 against the limit stop 2 of the furniture carcass 1. The spring-loaded latch 17 is mounted pivotably in the pivot bearing 20 and is likewise pretensioned by a torsion spring 23. The latch 17 engages in the catch projection 13 of the disengaging lever 8. The connecting members 16 are hinged pivotably in a pivot bearing 21 on the leg 14 of the disengaging lever 8.

Figure 5:
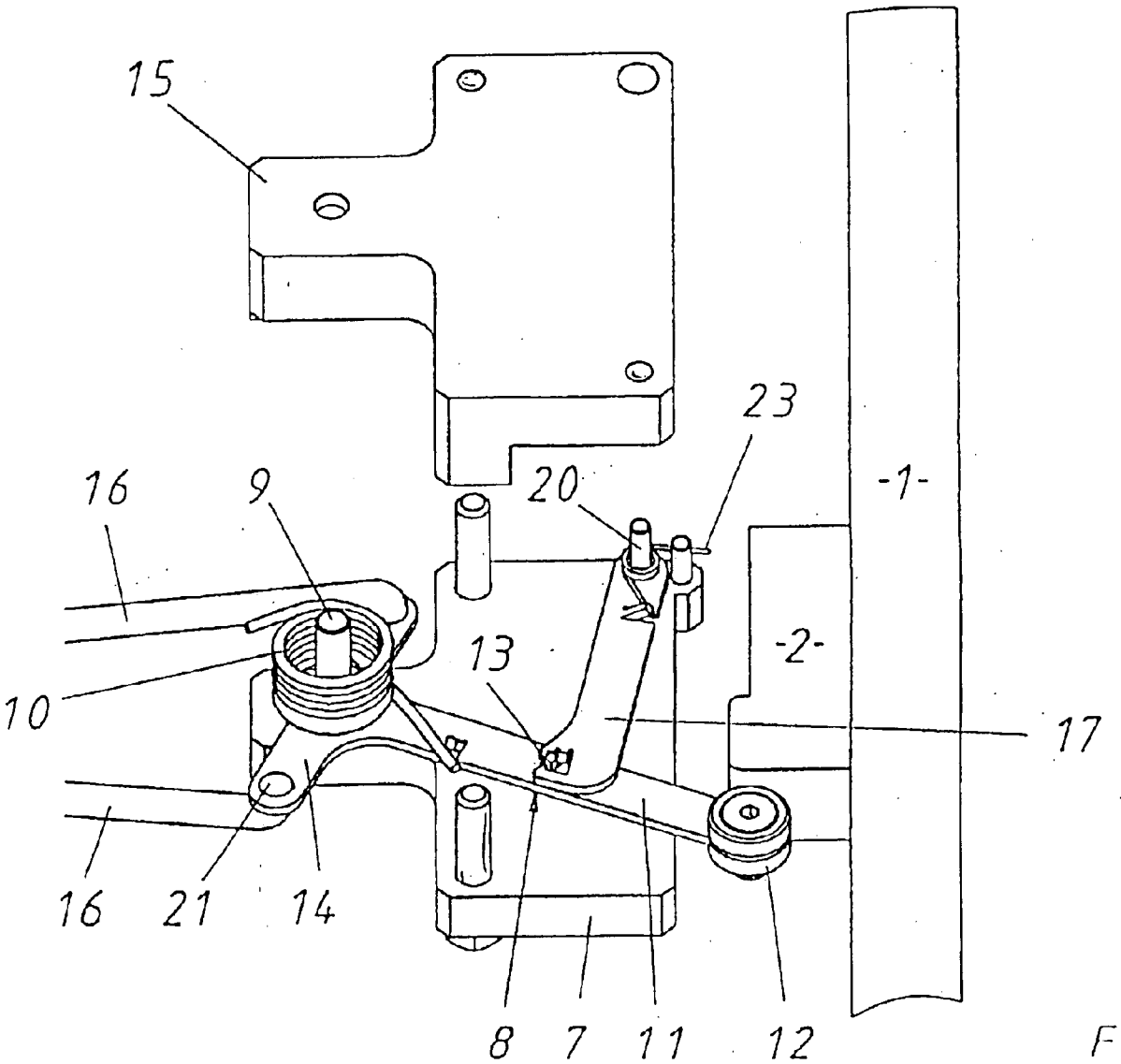
FIG. 5 a view in perspective of the device according to the invention as shown in FIGS. 1, 2 and 3.

FIG. 5 shows the trigger and drive member 6 in perspective view, wherein it may be seen that the entire device is preferably covered by a cover 15 which is fastened together with the assembly panel 17 on the bottom 4 of the drawer 3.

Figure 6:
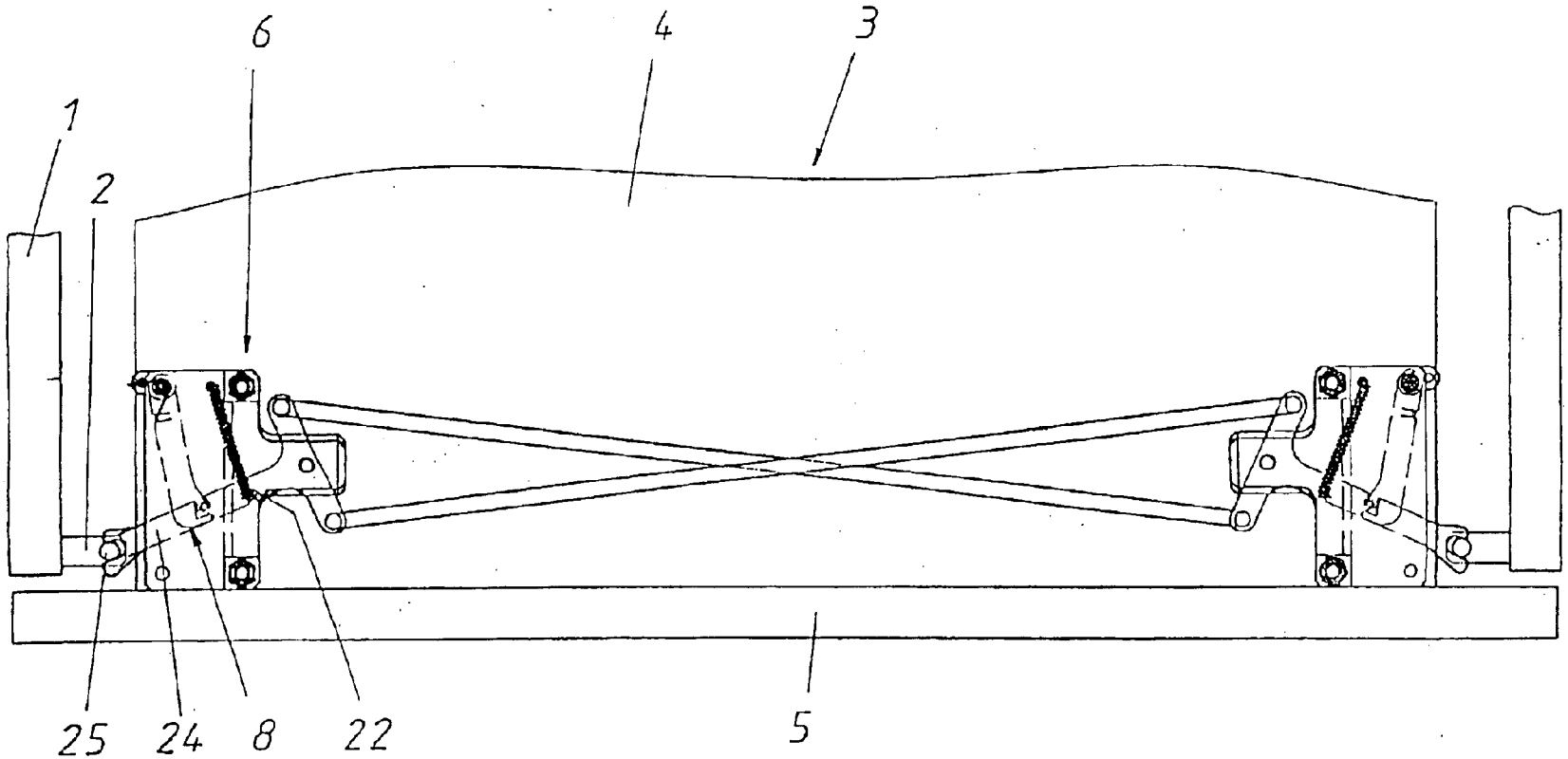
FIG. 6 another modified embodiment of the device according to the invention with a tension spring as energy storage device and fork-shaped disengaging lever in the closed position of the drawer.
Figure 7:
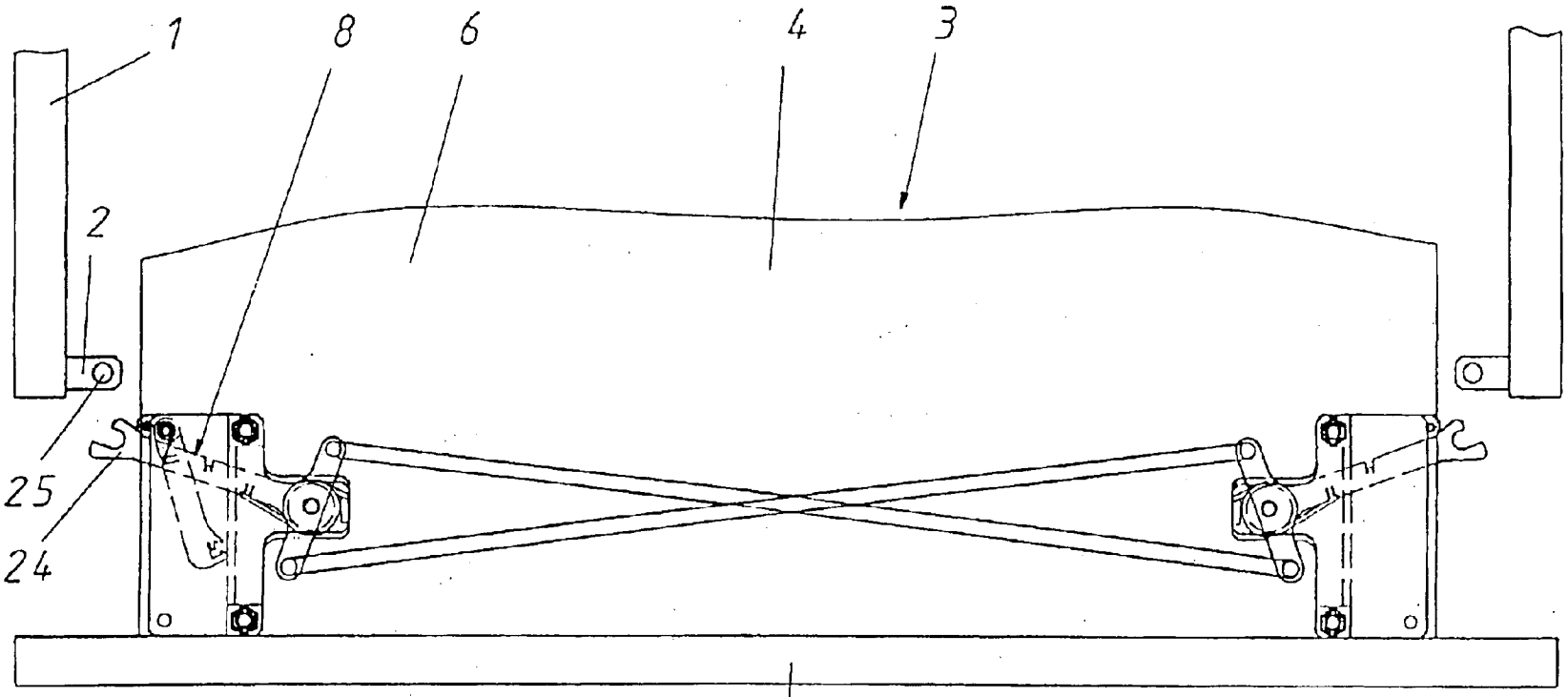
FIG. 7 the embodiment according to FIG. 6 using a torsion spring as the energy storage device in the open position of the drawer.

The development in FIGS. 6 and 7 corresponds in principle to the development in FIGS. 1 and 2, wherein in this case, however, the disengaging levers 8 are again pretensioned by a tension spring 22 and possess a fork-like leg 24 which engages in a limit stop pin 26 on the furniture carcass. Due to the fork-like legs 24 and the associated limit stop pins 25 a still better synchronous movement of the disengaging levers 8 can be achieved.

Figure 8:
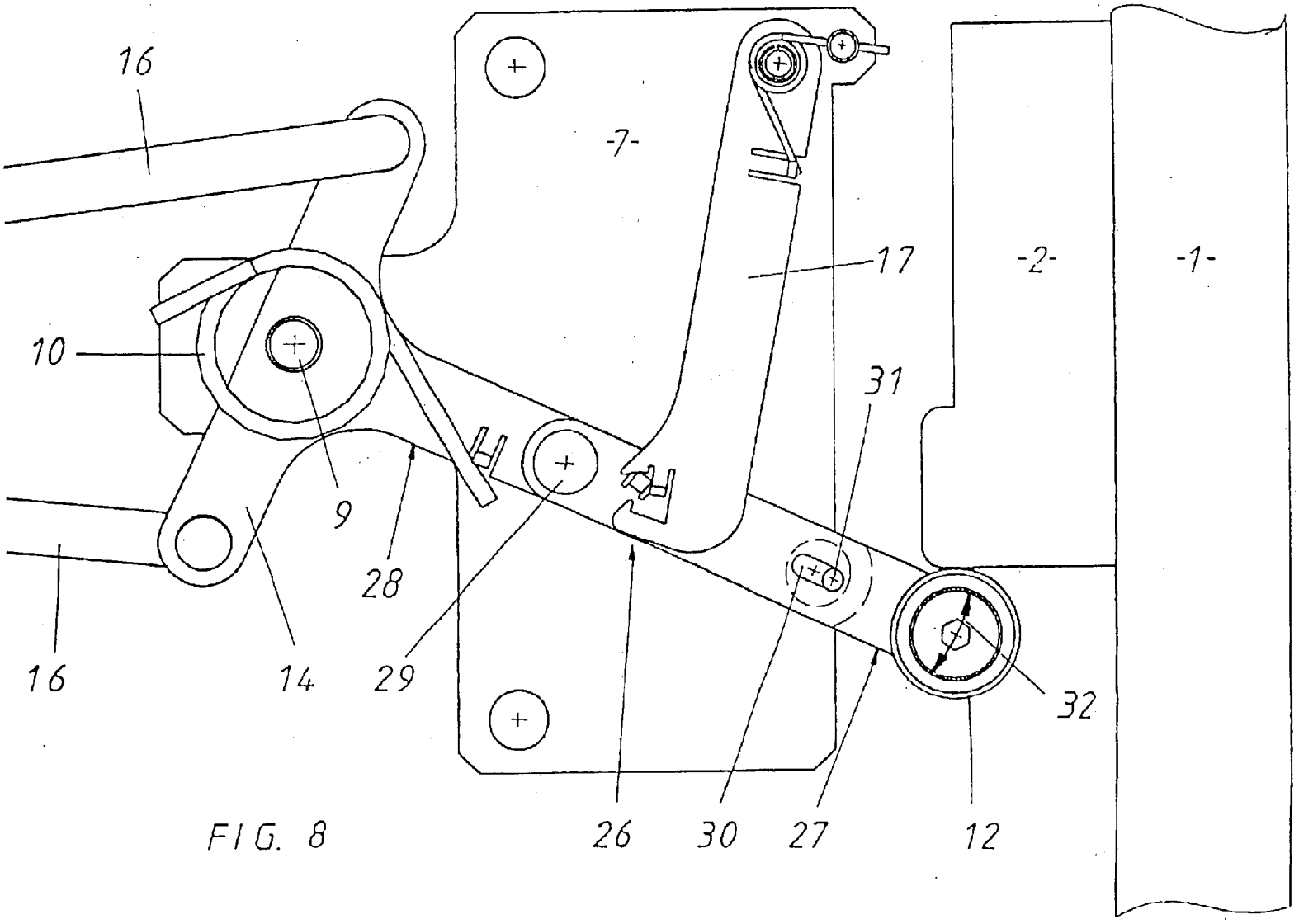
FIG. 8 a view of the device according to FIG. 4 but with a two-piece, inherently adjustable disengaging lever.

FIG. 8 shows an embodiment of the trigger and drive members 6 having a two-piece disengaging lever 26. The disengaging lever comprises a sensor part 27 on which the sensor roller 12 is arranged and a control part 28 on which the connecting members 16 are articulated. The control part 28 possesses a pivot bearing 29 by means of which the sensor part 27 is pivotably mounted. At a distance from the pivot bearing 29 the sensor part 27 possesses an oblong hole 30 into which an adjusting screw having an eccentric pin arranged on the control part engages. If the adjusting screw 31 is turned the sensor part 27 pivots about the pivot bearing 29 whereby the sensor roller 12 can be adjusted in the direction of the arrow 32. By this means the gap space on the front 5 of the drawer relative to the furniture carcass 1 can be determined. Furthermore, the limit stop position of one disengaging lever 8 can be matched to the limit stop position of the opposite disengaging lever 8.

Figure 9:
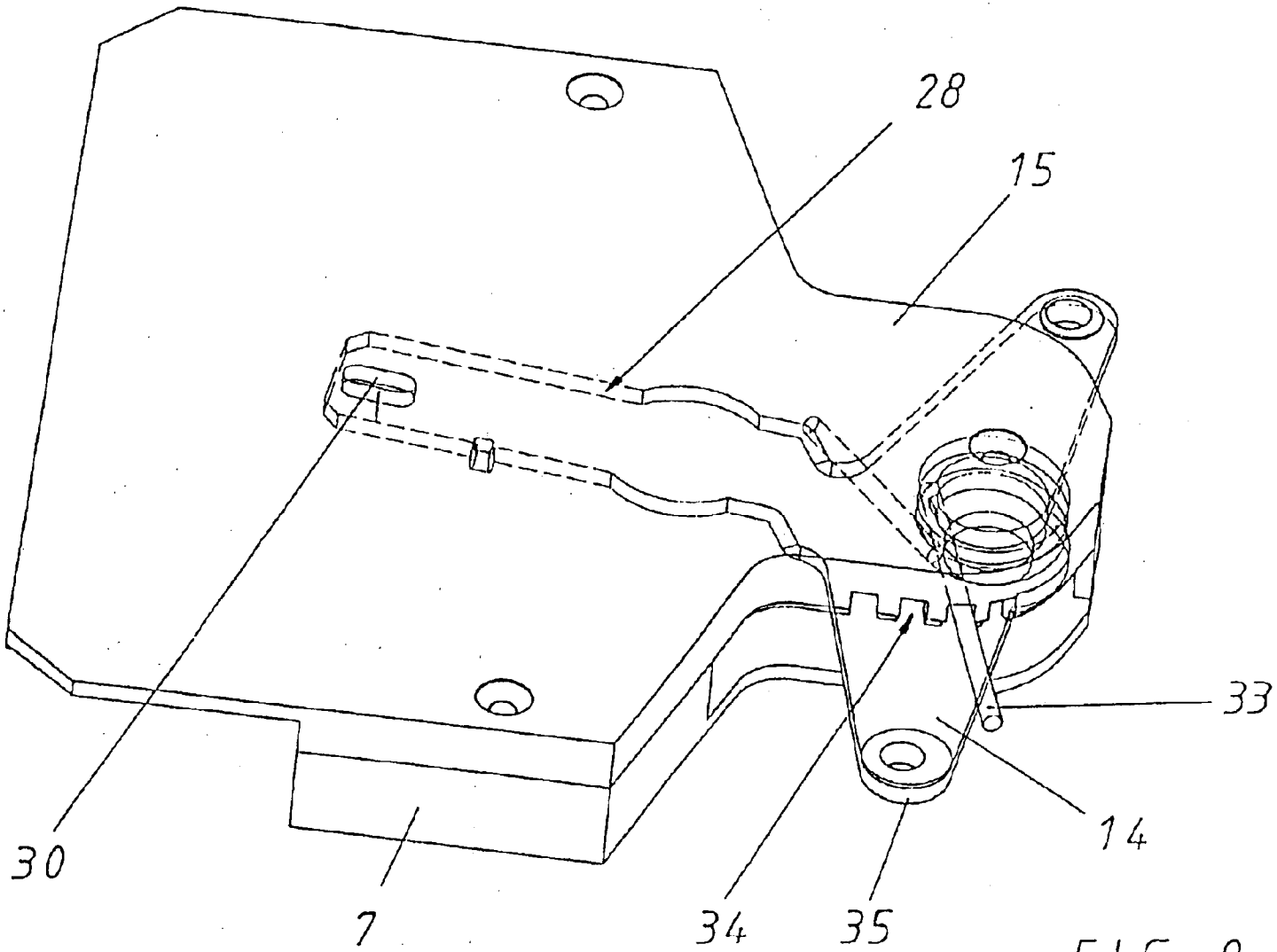
FIG. 9 the embodiment according to FIG. 8 with the cover closed having a catch device for setting the tension of the spring.

FIG. 9 shows the control part 28 of the disengaging lever 26 illustrated in FIG. 8 which is fastened pivotably on the assembly panel 7. The disengaging lever 26 is pretensioned by a torsion spring 33 which in this embodiment has an extended adjusting lever by means of which the force of the spring, ie the pretensioning of the spring 33, is adjustable. For this purpose the cover 15 possesses a toothed arrangement 34 which makes it possible to engage the adjusting lever of the spring 33 into different positions of the toothed structure 34. Each position corresponds to a certain initial tension in the spring 33. In this way the force exerted as a whole on the disengaging levers 8 can be adjusted. The toothed arrangement 34 with the adjustable spring 33 is also readily discernible in FIG. 18.

Furthermore, in FIG. 9 the bearings for the connecting members 16 on the leg 28 may be seen which can possess an eccentric bush 35 by which means the differences in length of the connecting members may be compensated.

Figure 10:
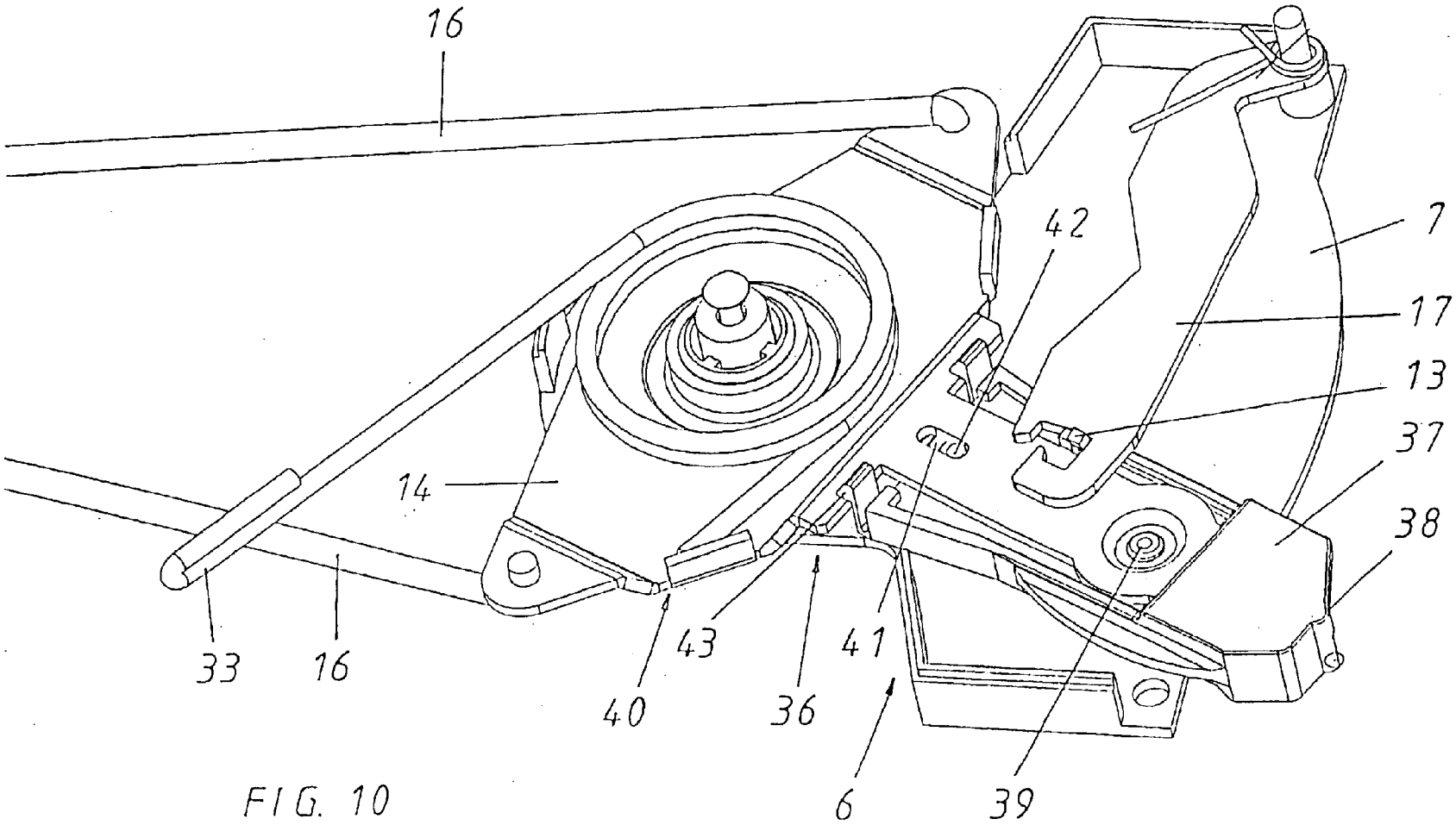
FIG. 10 an embodiment modified with respect to FIG. 8 having a two-piece, inherently adjustable disengaging lever in the locked position.
Figure 11:
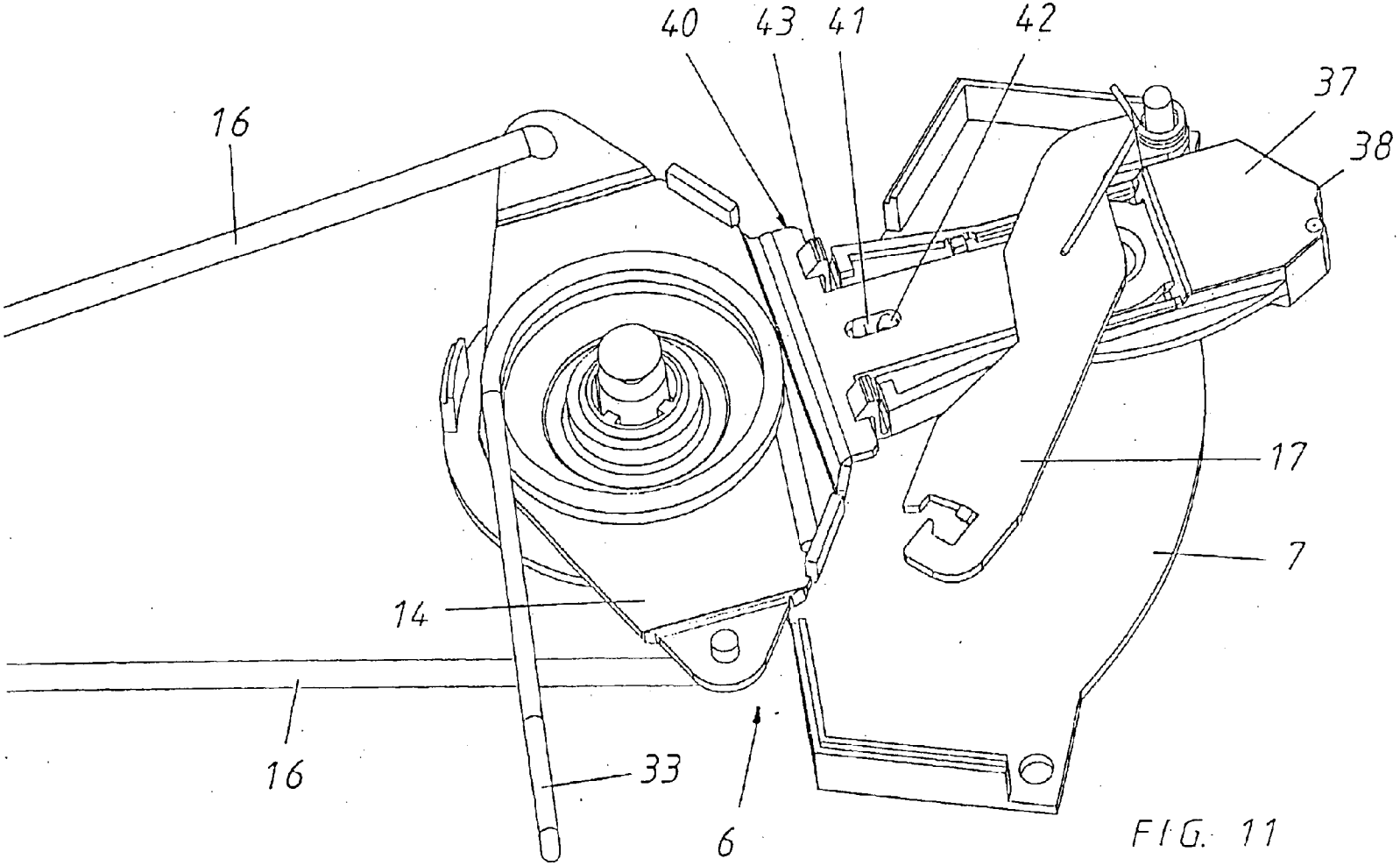
FIG. 11 the embodiment of FIG. 10 having a two-piece, inherently adjustable disengaging lever in the open position.

FIGS. 10 and 11 show another embodiment of the trigger and drive member 6 having a two-piece disengaging lever 36. The two possible end positions of the disengaging lever 36 are illustrated in each case. The disengaging lever 36 comprises a sensor part 37 having a sensor limit stop 38 instead of a sensor roller. The sensor limit stop 38 preferably consists of a noise-muffling, flexible plastic or rubber material. The control part 40 on which the connecting members 16 are hinged has a pivot bearing 39 at the front end in which the sensor part 37 is pivotably mounted. The sensor part 37 is connectable by means of a catch connection 43 to the control part 40. An oblong hole 41 is arranged in the control part 40 and into the oblong hole 41 engages an eccentric pin of an adjusting screw 42 which is held in the sensor part 37. As already described in connection with FIG. 8 by turning the adjusting screw 42 it is possible to adjust the position of the sensor limit stop 38 with respect to the limit stop 2 of the furniture carcass 1. The torsion spring 33 constructed with an adjusting lever which allows adjustment of the force exerted by the spring 33 may also be seen. FIG. 10 shows the disengaging lever in the engaged position of the latch 17 when the drawer is closed whereas FIG. 11 shows the disengaging lever in its end position when the drawer is open.

Figure 12:
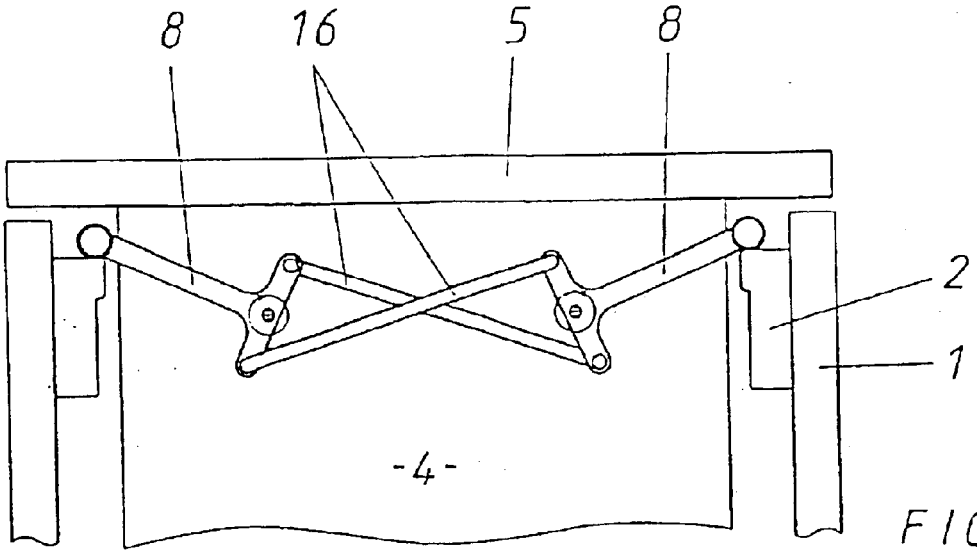
FIG. 12 coupling of the trigger and drive members by means of two connecting members laid crosswise.

In FIGS. 12 to 17 different variants and refinements of the connecting members 16 are illustrated. FIG. 12 shows the T-shaped disengaging levers 8 illustrated in the preceding figures with connecting members in the form of a double crossover connection, each connecting member 16 being capable of loading only by tension. The connecting members 16 may be designed as belt- or rod-shaped members or alternatively as cable or Bowden controls.

Figure 13:
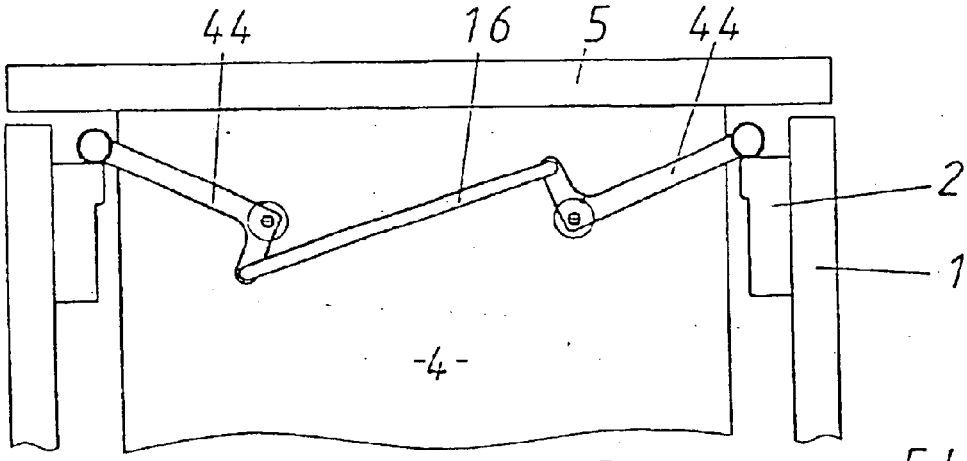
FIG. 13 coupling of the trigger and drive members by means of a connecting member capable of being put under load by tension and pressure.

FIG. 13 shows approximately L-shaped disengaging levers 44 having a simple cross connection by means of a connecting member 16 capable of being put under load by tension and compression which in this development is constructed by way of example in the form of rigid profile members.

Figure 14:
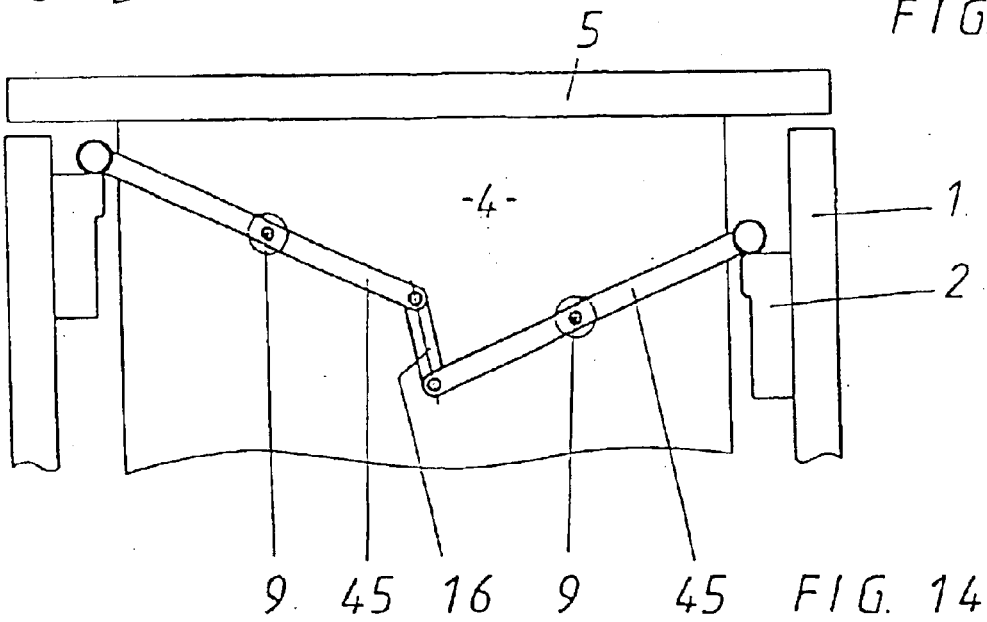
FIG. 14 coupling of the trigger and drive member by means of a short, central connecting member.

FIG. 14 illustrates straight disengaging levers 45 mounted at approximately half their length in the bearings 9 which levers are connected to one another via connecting member 16 constructed as a short central guide bar.

Figure 15:
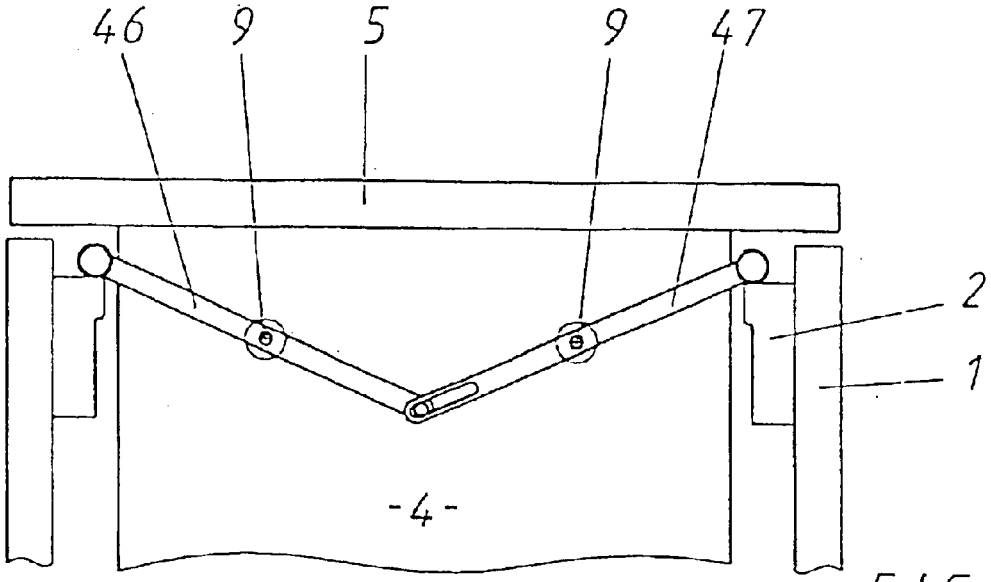
FIG. 15 direct coupling of the trigger and drive members by means of an oblong guide.

In FIG. 15 straight disengaging levers designed in a fashion similar to FIG. 14 are illustrated, wherein one disengaging lever 46 has a pin which engages in an oblong hole of the other disengaging lever 47 and the two disengaging levers 46 and 47 are coupled to one another in a manner transmitting path and force.

Figure 16:
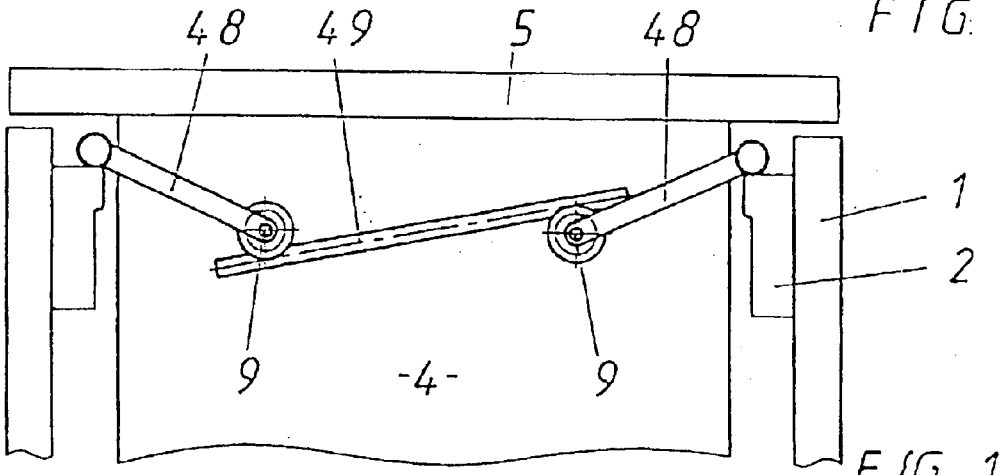
FIG. 16 coupling of the trigger and drive members by means of a rack-and-pinion gear.

FIG. 16 shows the possibility of coupling the disengaging levers by means of a toothed rack 49, wherein both disengaging levers 48 possess a gear wheel arranged fixedly on the lever and are rotatable about the axis of rotation 9.

Figure 17:
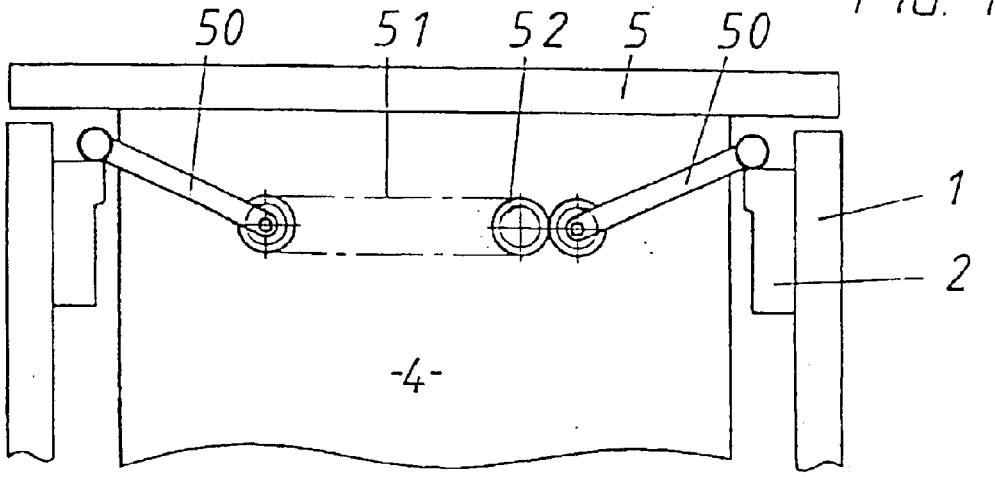
FIG. 17 coupling of the trigger and drive members by means of a toothed belt.

FIG. 17 shows a cross-connection by means of a chain, toothed belt or the like, wherein a disengaging lever 50 is provided with a gear wheel which is connected via a toothed belt or a chain 51 to a gear wheel 52. The gear wheel 52 meshes with a wider gear wheel of the disengaging lever 50 located opposite and thus ensures the reversal of direction necessary for synchronous path of the disengaging levers 50.

Figure 18:
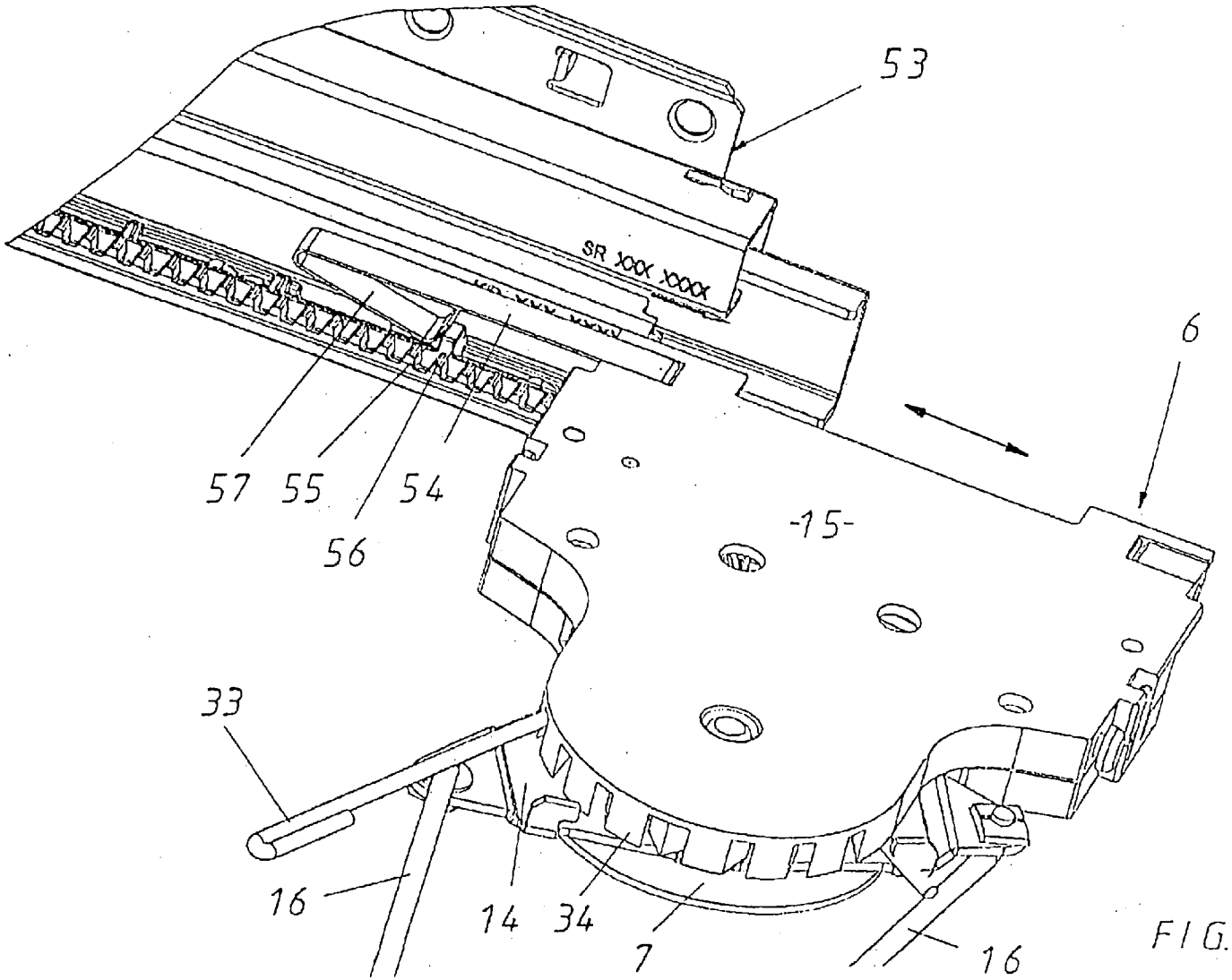
FIG. 18 an illustration of the device according to the invention having means for limiting the opening travel.

FIG. 18 shows a possibility for limiting the automatic opening movement of the drawer by the spring-loaded disengaging levers 8. The draw-out guide 53 of the drawer and a trigger and drive member 6 fastened to the bottom of the drawer (not shown) may be seen. On the cover 15 of the trigger and drive member 6 a leaf sprig 54 oriented approximately parallel to the draw-out guide 53 is fastened. This leaf spring 54 moves together with the drawer and the trigger and drive member 8 parallel to the draw-out guide 53. The automatic opening movement of the drawer is now stopped by the leaf spring after a certain opening travel in that a limit stop slope 55 of the leaf spring strikes against a limit stop 56 arranged in fixed position on the draw-out guide 53 or the furniture carcass. The drawer can now be pulled out further by hand by overcoming the spring tension of the leaf spring 54, whereby the limit stop slope 55 slides over the limit stop 56 and releases the drawer. On pushing in the drawer a run-in slope 57 of the leaf spring 54 slides with little resistance over the limit stop 56. The leaf spring 54 is now once again in the position to stop the opening movement of the drawer.

Legend to the drawing

| | | | |
|---|---|---|---|
| 1 | Furniture carcass | 31 | Adjusting screw with eccentric pin |
| 2 | Limit stop | 32 | Direction of arrow |
| 3 | Drawer | 33 | Torsion spring with adjusting lever |
| 4 | Bottom of drawer | 34 | Toothed arrangement |
| 5 | Front of drawer | 35 | Eccentric bush |
| 6 | Trigger and drive member | 36 | Disengaging lever (two-piece) |
| 7 | Assembly panel | 37 | Sensor part |
| 8 | Disengaging lever (T-shaped) | 38 | Sensor limit stop |
| 9 | Pivot bearing | 39 | Pivot bearing |
| 10 | Tosion spring | 40 | Control part |
| 11 | Leg | 41 | Oblong hole |
| 12 | Sensor roller | 43 | Catch connection |
| 13 | Catch projection | 44 | Disengaging lever (L-shaped) |
| 14 | Leg | 45 | Disengaging lever (straight) |
| 15 | Cover | 46 | Disengaging lever (with pin) |
| 16 | Connecting members | 47 | Disengaging lever (with oblong hole) |
| 17 | Latch | 48 | Disengaging lever (with gear wheel) |
| 18 | Direction of arrow | 49 | Toothed rack |
| 19 | Direction of arrow | 50 | Disengaging lever (with gear wheel) |
| 20 | Pivot bearing | 51 | Toothed belt |
| 21 | Pivot bearing | 52 | Gear wheel |
| 22 | Tension spring | 53 | Draw-out guide |
| 23 | Torsion spring | 54 | Leaf spring |
| 24 | Forked leg | | |
| 25 | Limit stop pin | | |
| 26 | Disengaging lever (two-piece) | | |
| 27 | Sensor part | | |
| 28 | Control part | | |
| 29 | Pivot bearing | | |
| 30 | Oblong hole | | |

-continued

Legend to the drawing

| | | | |
|---|---|---|---|
| 55 | Limit stop slope | 56 | Limit stop |
| 57 | Run-in slope | | |

What is claimed is:

1. Device for opening and closing a movable furniture part relative to a furniture carcass, comprising:

two trigger and drive units mountable on the movable furniture part, each of the trigger and drive units having a trigger member activatable in response to an application of an external force and a drive member coupled to the trigger member urging the movable furniture part from a closed position towards an open position of the movable furniture part relative to the furniture carcass upon activation of the trigger member, wherein each trigger and drive unit further comprises a pivotable, spring-biased disengaging lever, said lever, in cooperation with a limit stop arranged in a fixed position on the furniture carcass, determining the closed and open position of the movable furniture part; and at least one locking member for locking the movable furniture part in the closed position and activatable to release the movable furniture part in response to the application of the external force on at least one of the trigger members, wherein the two trigger and drive units are coupled to one another synchronously and substantially without play by a path- and force-transmitting means.

2. Device according to claim 1, wherein the respective trigger and drive units are arranged on opposite sides of the movable furniture part.

3. Device for opening and closing a movable furniture part relative to a furniture carcass, comprising:

two trigger and drive units mountable on the movable furniture part, each of the trigger and drive units having a trigger member activatable in response to an application of an external force and a drive member coupled to the trigger member urging the movable furniture part from a closed position towards an open position of the movable furniture part relative to the furniture carcass upon activation of the trigger member, wherein each trigger and drive unit further comprises a pivotable, spring-biased disengaging lever, said lever, in cooperation with a limit stop arranged in a fixed position on the furniture carcass, determining the closed and open position of the movable furniture part; and at least one locking member for locking the movable furniture part in the closed position and activatable to release the movable furniture part in response to the application of the external force on at least one of the trigger members, wherein the two trigger and drive units are coupled to one another synchronously and substantially without play by a path- and force-transmitting means, wherein in the closed position of the movable furniture part, an end of the disengaging lever of each trigger and drive unit rests against the limit stop of the furniture carcass.

4. Device for opening and closing a movable furniture part relative to a furniture carcass, comprising:

two trigger and drive units mountable on the movable furniture part, each of the trigger and drive units having a trigger member activatable in response to an application of an external force and a drive member coupled to the trigger member urging the movable furniture part from a closed position towards an open position of the movable furniture part relative to the furniture carcass upon activation of the trigger member, wherein each trigger and drive unit further comprises a pivotable, spring-biased disengaging lever, said lever, in cooperation with a limit stop arranged in a fixed position on the furniture carcass, determining the closed and open position of the movable furniture part; and at least one locking member for locking the movable furniture part in the closed position and activatable to release the movable furniture part in response to the application of the external force on at least one of the trigger members, wherein the two trigger and drive units are coupled to one another synchronously and substantially without play by a path- and force-transmitting means, wherein the disengaging lever of each trigger and drive unit is constructed in the form of a guide bar possessing at least first and second legs, the first leg forming the trigger member and the second leg of each disengaging lever being coupled via at least one path- and force-transmitting connecting member of the path- and force-transmitting means to the second leg of the respective other disengaging lever.

5. Device for opening and closing a moveable furniture part relative to a furniture carcass, comprising:

two trigger and drive units mountable on the movable furniture part, each of the trigger and drive units having a trigger member activatable in response to an application of an external force and a drive member coupled to the trigger member urging the movable furniture part from a closed position towards an open position of the movable furniture part relative to the furniture carcass upon activation of the trigger member; and at least one locking member for locking the movable furniture part in the closed position and activatable to release the movable furniture part in response to the application of the external force on at least one of the trigger members, wherein the two trigger and drive units are coupled to one another synchronously and substantially without play by a path- and force-transmitting means, wherein the at least one locking member further comprises a spring-loaded latch temporarily connected to one of the two trigger and drive units in the closed position of the movable furniture part.

6. Device for opening and closing a moveable furniture part relative to a furniture carcass, comprising:

two trigger and drive units mountable on the movable furniture part, each of the trigger and drive units having a trigger member activatable in response to an application of an external force and a drive member coupled to the trigger member urging the movable furniture part from a closed position towards an open position of the movable furniture part relative to the furniture carcass upon activation of the trigger member; and at least one locking member for locking the movable furniture part in the closed position and activatable to release the movable furniture part in response to the application of the external force on at least one of the trigger members, wherein the two trigger and drive units are coupled to one another synchronously and substantially without play by a path- and force-transmitting means, wherein the at least one locking member and one of the two trigger and drive units are arranged on a common assembly panel fastenable to the movable furniture part.

* * * * *